US007562693B2

(12) United States Patent
Mau

(10) Patent No.: US 7,562,693 B2
(45) Date of Patent: Jul. 21, 2009

(54) SPRAYING APPARATUS FOR FORMING LOW-MELTING-POINT METAL MOLD

(75) Inventor: Tsuo Fei Mau, Changhua Hsien (TW)

(73) Assignee: Chien Kuo Technology University, Changhua (TW)

( * ) Notice: Subject to any disclaimer, the term of this patent is extended or adjusted under 35 U.S.C. 154(b) by 526 days.

(21) Appl. No.: 11/498,878

(22) Filed: Aug. 4, 2006

(65) Prior Publication Data

US 2008/0029239 A1 Feb. 7, 2008

(51) Int. Cl.
*B22D 23/00* (2006.01)

(52) U.S. Cl. ..... 164/271; 164/46

(58) Field of Classification Search ..... 164/46, 164/271, 19, 250.1, 154.1, 155.1
See application file for complete search history.

(56) References Cited

U.S. PATENT DOCUMENTS 5,787,965 A * 8/1998 Sterett et al. ..... 164/155.3

* cited by examiner

*Primary Examiner*—Kevin P Kerns
(74) *Attorney, Agent, or Firm*—Senniger Powers LLP

(57) ABSTRACT

A spraying apparatus for forming low-melting-point metal mold. The spraying apparatus includes a frame body having a platform. A close space having an operation area is defined above the platform. An adjustment seat having an operation table is arranged on one side of the platform corresponding to the operation area. The adjustment seat is multidirectionally displaceable and 360-degree rotatable and adjustable in angle. A spraying system is mounted on the other side of the platform. The spraying system includes a material-supplying container, a high-pressure pump and a spraying gun. A temperature-controlling box is disposed on a lower side of the frame body. The temperature-controlling box has a power switch, a first-stage temperature control, a second-stage temperature control and a third-stage temperature control which are respectively electrically connected to the material-supplying container, the high-pressure pump and the spraying gun for heating the same to a set temperature. The spraying gun is controlled by a pedal switch. Various sizes of nozzles are adaptable to the spraying gun for performing the spraying operation.

10 Claims, 10 Drawing Sheets

SPRAYING APPARATUS FOR FORMING LOW-MELTING-POINT METAL MOLD

BACKGROUND OF THE INVENTION

The present invention is related to a spraying apparatus for forming low-melting-point metal mold. The spraying apparatus includes a spraying system and a cooperative adjustment seat for performing the spraying operation to form the low-melting-point metal mold. The molten metal is directly sprayed onto the surface of the model many times to form a metal coating thereon without contraction. The mold is made by means of many times of spraying operation so that the mold will not deform due to internal stress. The low-melting-point metal mold is free from the problems of contraction and deformation. In addition, the mold can be more quickly made at higher precision. Also, when not used, the low-melting-point metal molds can be recovered and molten into liquid metal for reuse. (The recovery ratio is up to 80~95%.) The low-melting-point metal mold will not lead to any environmental problem due to the resin mixed with the metal.

A conventional low-melting-point metal fast mold is manufactured according to casting principles. The low-melting-point metal is first heated and molten. Then the molten metal is directly poured into a plaster mold or ceramic mold. After the molten metal is cooled and solidified, a fast metal mold is obtained. Such manufacturing method has some shortcomings as follows:

1. During the transfer manufacturing procedure, the plaster or ceramic mold will contract and deform.
2. In the casting operation, a cooling apparatus is arranged for cooling the molten metal. However, such cooling apparatus can hardly fully evenly cool the molten metal. Therefore, the stress will concentrate on a certain part of the mold to lead to deformation of the mold.
3. It takes a considerably long time to manufacture the mold so that the manufacturing cost is relatively high. It takes about two days to transfer manufacture the fast metal mold with a plaster mold. It takes about 3~5 days to transfer manufacture the fast metal mold with a ceramic mold.

There is another measure for manufacturing the low-melting-point metal fast mold. The middle-melting-point zinc alloy wire material is positioned between the positive and negative electrodes of an electric arc gun. The zinc alloy wire material is molten by high electric arc. At the same time, by means of high-pressure air, the molten metal is atomized to adhere to the surface of the mold to form the fast metal mold. Such technique has some shortcomings as follows:

1. The working environment is dangerous and hard. High voltage power is used to melt the zinc alloy (with a high melting point of about 430° C.). Therefore, the work is dangerous. In addition, the high-pressure gas and the high-voltage electric arc cause great noise in the working site. Therefore, the working environment is very hard.
2. The mold has poor precision and serious deformation. Due to the high temperature, high stress and great contraction ratio of the zinc alloy (1%~1.1%), the demolding face and the mold-dividing face of the mold often deform seriously. The faces of the mold tend to have reverse hooks. In addition, it often takes place that the mold sections cannot be truly mated. Therefore, such technique is only applicable to those molds without high requirement for precision and free from the demolding problem, such as the molds for injection molding soft products of rubber material, for example, sole, tire, etc.

3. The mold lamination speed is slow so that it takes long time to manufacture the mold. In general, only a mold shell with a thickness within 1 mm~2 mm is made. Then the mold shell is filled with a metal resin backup material. Such mold includes metal and unrecoverable thermosetting metal resin mixed with the metal. The bonding between the metal and the resin is poor. In addition, such mold will cause the problem of environmental protection.

SUMMARY OF THE INVENTION

It is therefore a primary object of the present invention to provide a spraying apparatus for forming low-melting-point metal mold. The spraying apparatus includes a spraying system and a cooperative adjustment seat for performing the spraying operation to form the low-melting-point metal mold. The molten metal is directly sprayed onto the surface of the model many times to form a metal coating thereon without contraction. The mold is made by means of many times of spraying operation so that the mold will not deform due to internal stress. The low-melting-point metal mold is free from the problems of contraction and deformation. In addition, the mold can be more quickly made at higher precision.

It is a further object of the present invention to provide the above spraying apparatus in which when not used, the low-melting-point metal mold can be recovered and molten into liquid metal for reuse. (The recovery ratio is up to 80~95%.) Therefore, the low-melting-point metal mold will not lead to any environmental problem due to the resin mixed with the metal.

It is still a further object of the present invention to provide the above spraying apparatus in which the adjustment seat includes a back and forth movable first substrate board, a left and right movable second substrate board, a 360-degree rotatable rotary tray and a pivotable operation block. Accordingly, the position of the operation table can be mobilely multidirectionally adjusted to facilitate the spraying operation.

The present invention can be best understood through the following description and accompanying drawings wherein:

DETAILED DESCRIPTION OF THE PREFERRED EMBODIMENTS

Figure 1:
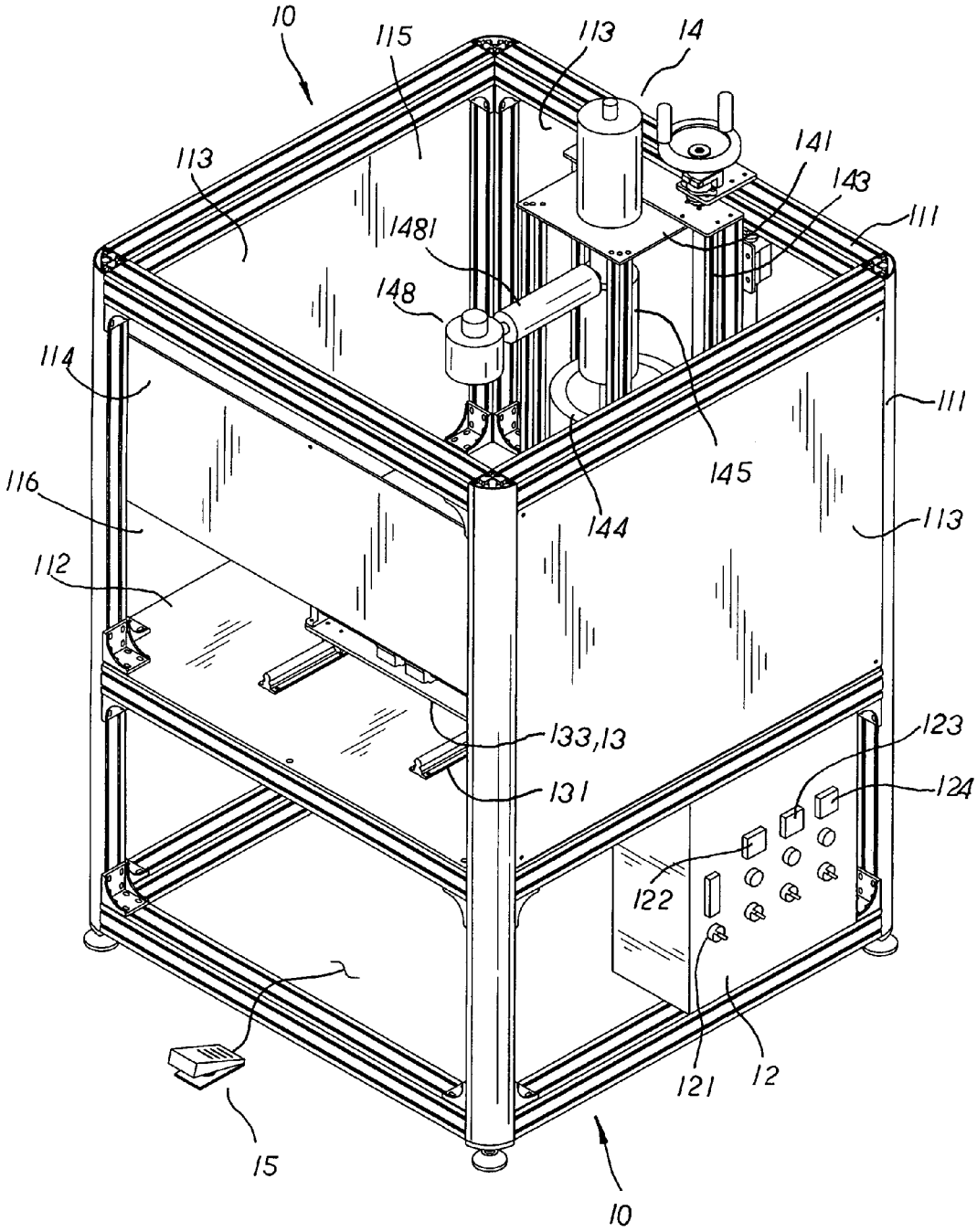
FIG. 1 is a front perspective view of the present invention.
Figure 2:
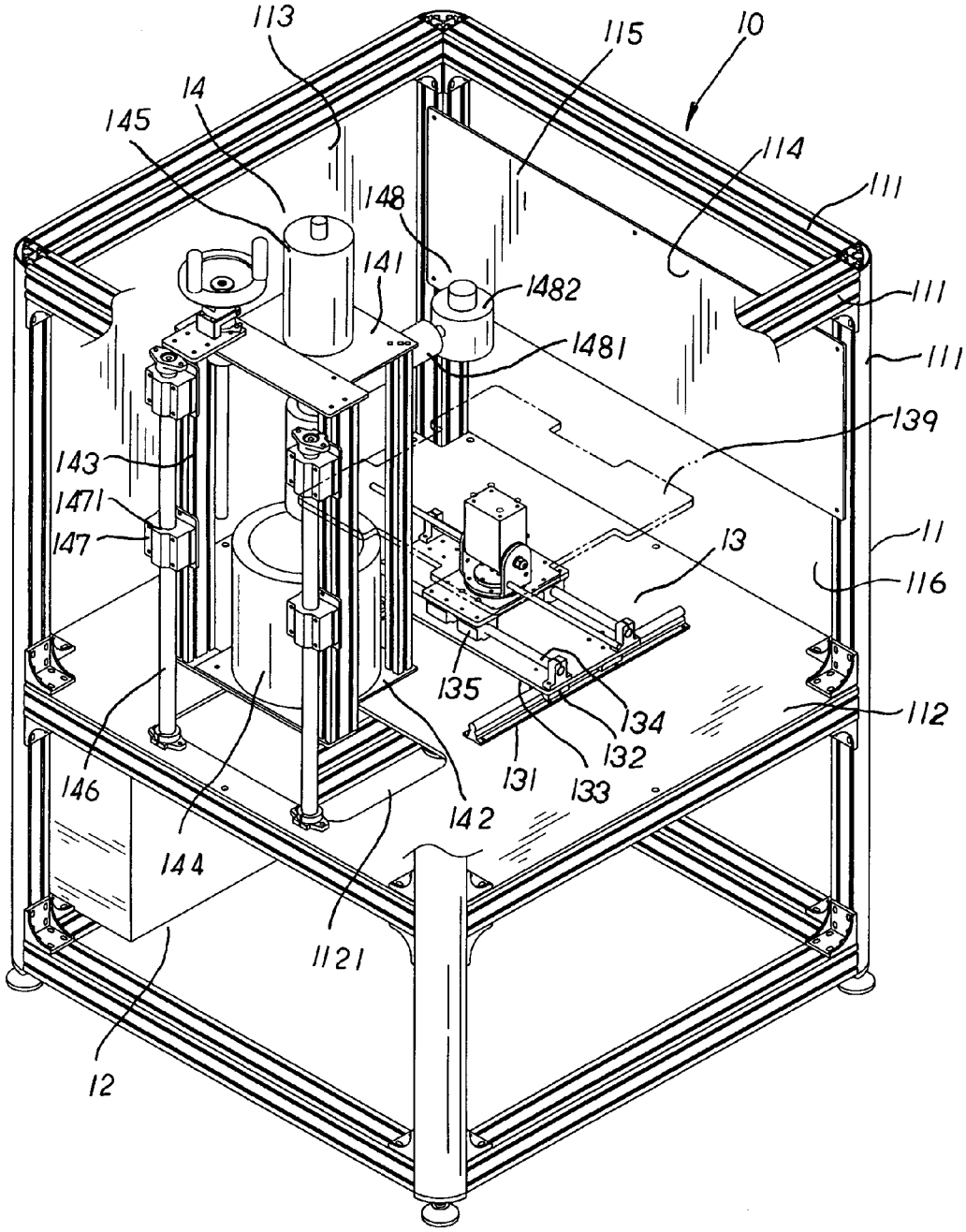
FIG. 2 is a rear perspective view of the present invention.
Figure 3:
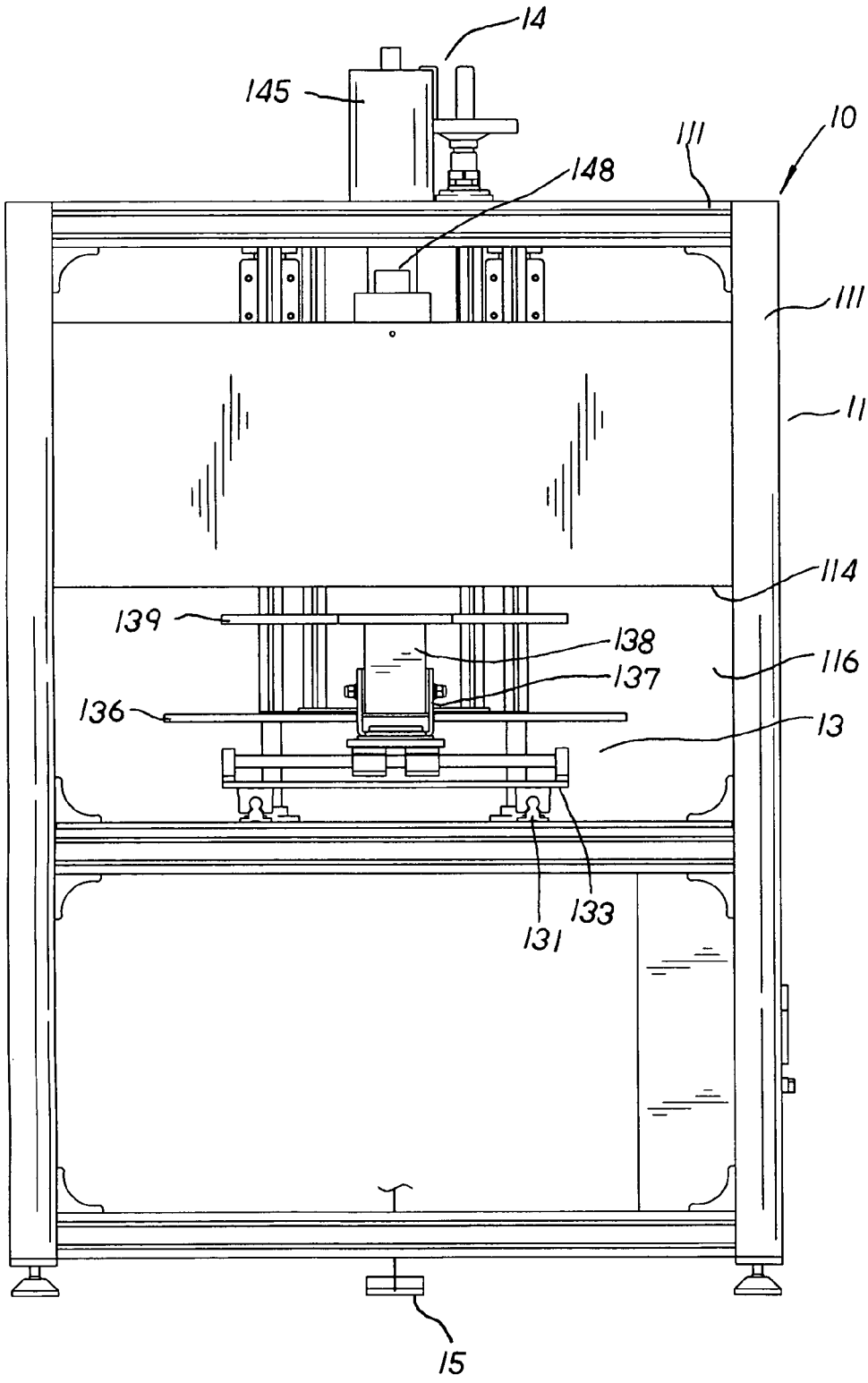
FIG. 3 is a front view of the present invention.
Figure 4:
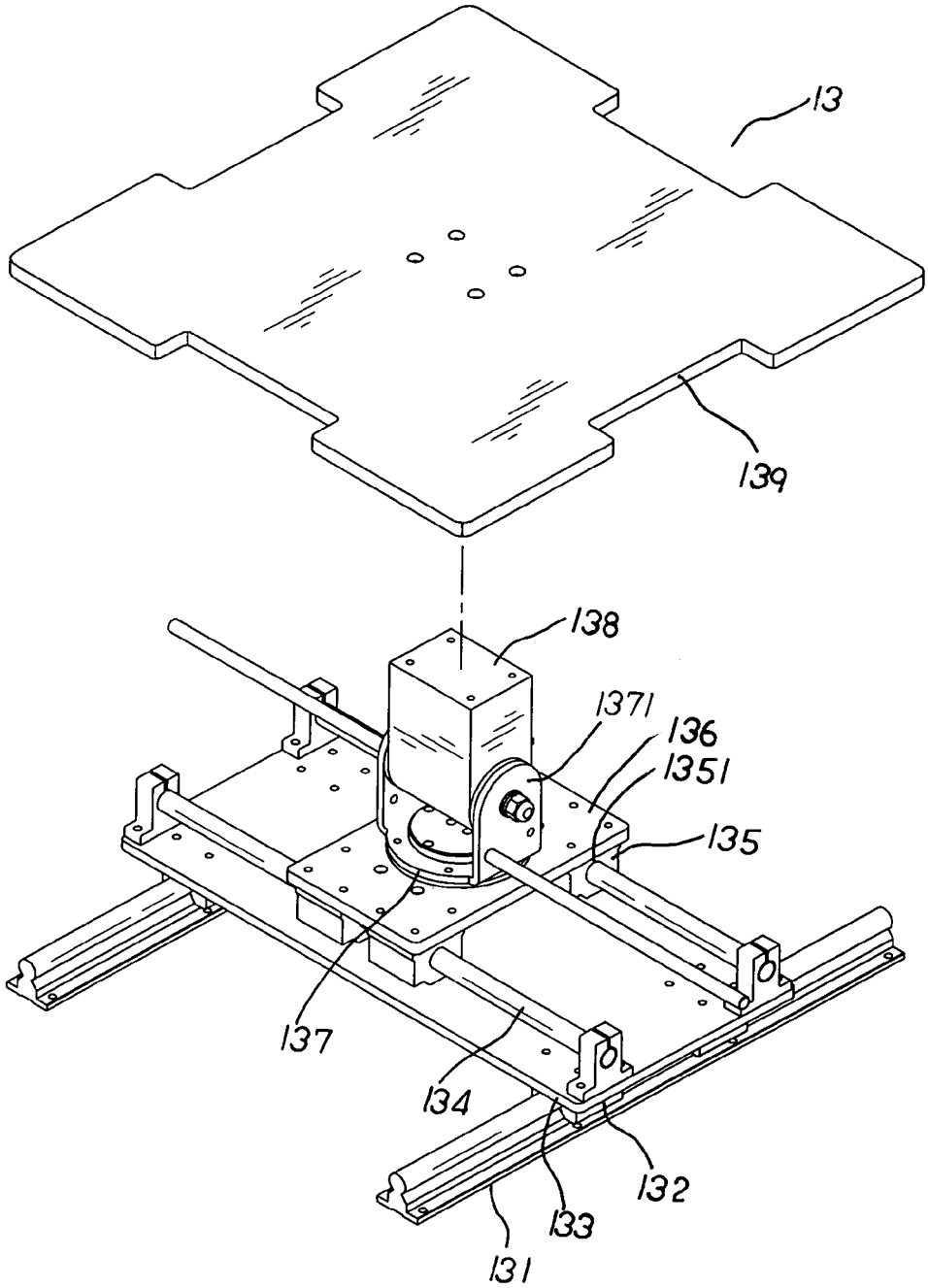
FIG. 4 is a perspective exploded view of the adjustment seat and the operation table of the present invention.
Figure 5:
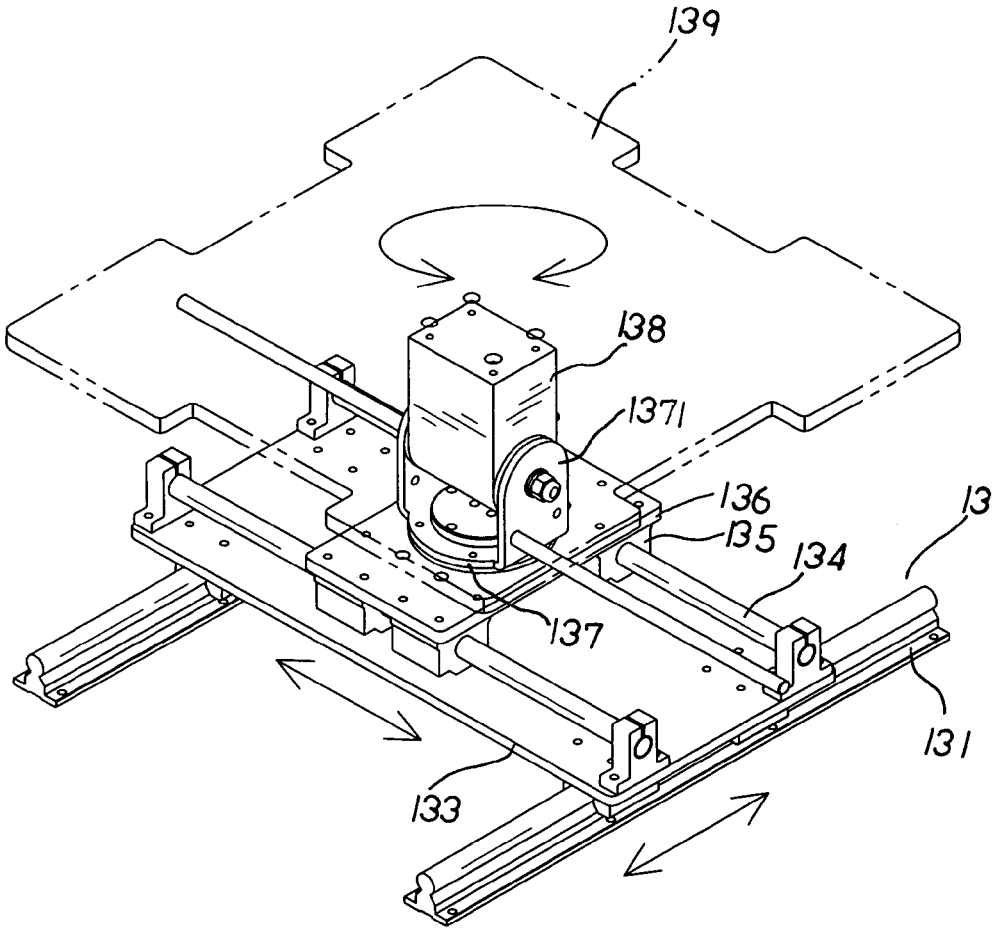
FIG. 5 is a perspective view showing that the adjustment seat and the operation table of the present invention are synchronously rotated and back and forth and left and right moved.
Figure 6:
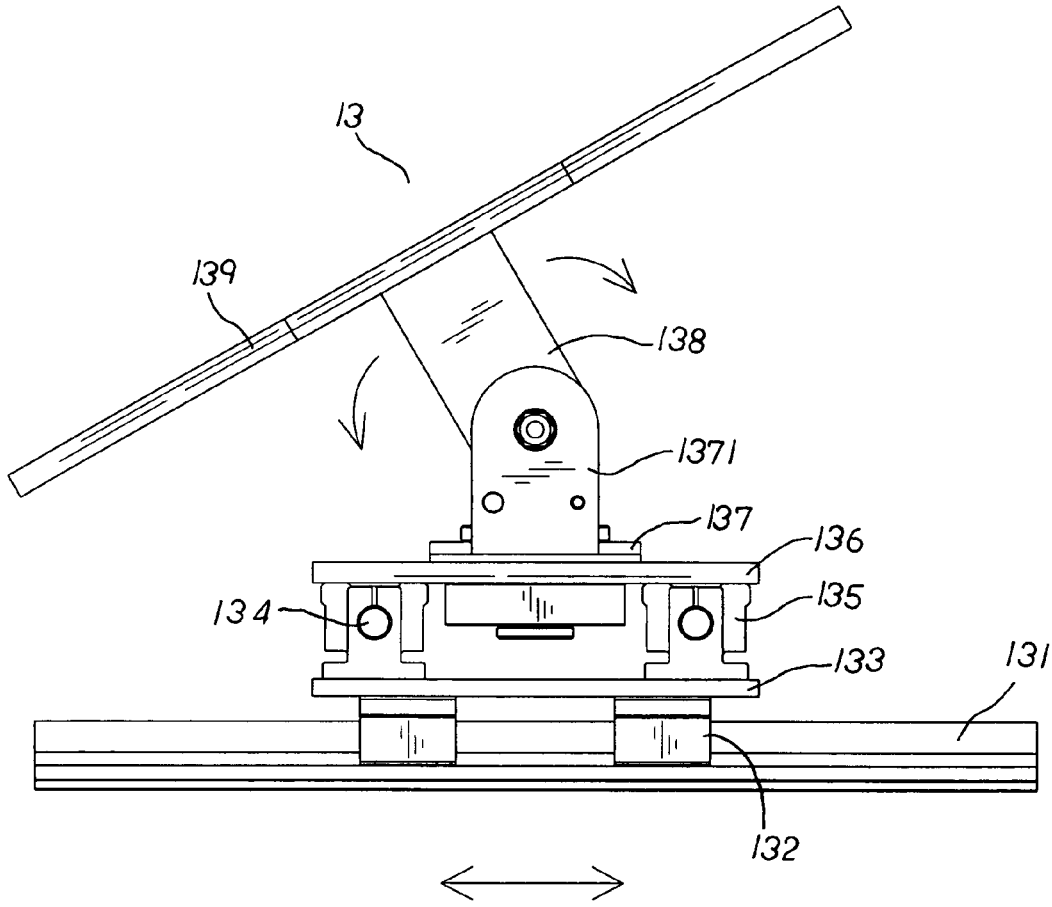
FIG. 6 is a perspective view showing that the operation table of the present invention is pivoted to adjust the angle of the operation table.
Figure 7:
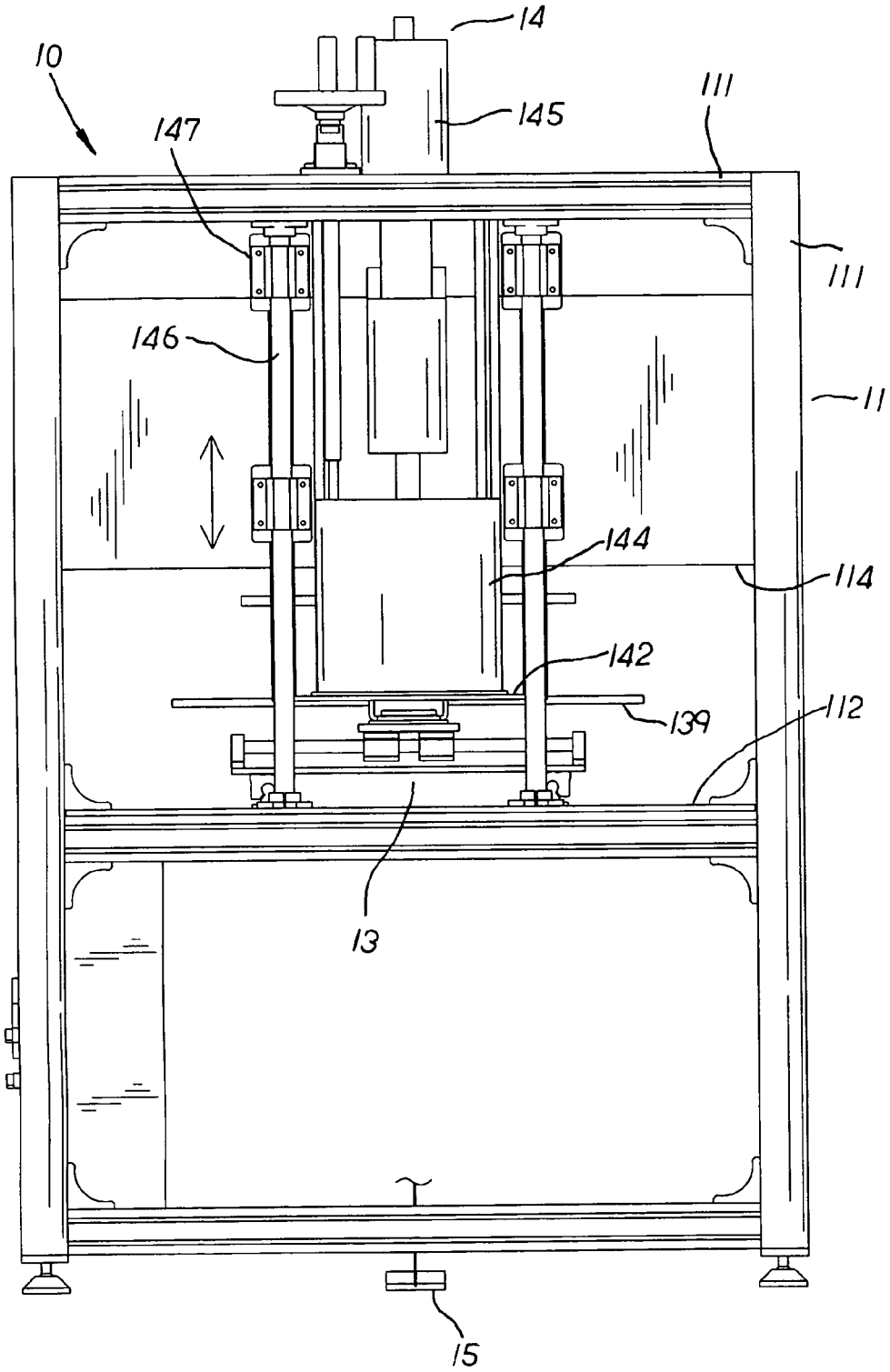
FIG. 7 is a rear view of the present invention.

Please refer to FIGS. 1 and 2. The spraying apparatus 10 of the present invention includes a frame body 11 composed of several longitudinal columns 111 and transverse beams 111. A temperature-controlling box 12 is disposed on a lower side of the frame body 11. The temperature-controlling box 12 has a power switch 121, a first-stage temperature control 122, a second-stage temperature control 123 and a third-stage temperature control 124. A platform 112 is mounted above the temperature-controlling box 12. Three shielding boards 113 and a transparent board 114 are respectively disposed on four sides of the frame body 11 above the platform 112 to define a close space 115. The transparent board 114 is narrower to form an operation area 116 communicating with the close space 115. An adjustment seat 13 is arranged on one side of the platform 112 corresponding to the operation area 116 as shown in FIG. 3. The adjustment seat 13 is multidirectionally displaceable and 360-degree rotatable and adjustable in angle. Referring to FIGS. 4 and 5, the adjustment seat 13 includes a pair of T-shaped guide rails 131 symmetrically fixedly arranged on the platform 112. A first substrate board 133 having U-shaped first slide blocks 132 is disposed on the guide rails 131. The first slide blocks 132 are back and forth movable along the guide rails 131. Two guide rods 134 are symmetrically mounted on two sides of the first substrate board 133. The guide rods 134 can have a circular cross-section, a rectangular cross-section or any otherwise shaped cross-section. The guide rods 134 are fitted through the through holes 1351 of several second slide blocks 135 to connect with a second substrate board 136. The second slide blocks 135 are left and right movable along the guide rods 134. A 360-degree rotatable rotary tray 137 is disposed at the center of the second substrate board 136. The rotary tray 137 is U-shaped and has two support plates 1371. An operation block 138 is pivotally disposed between the support plates 1371 via a pivot shaft 1372. The operation block 138 is restricted by the support plates 1371, whereby the operation block 138 can be pivoted about the pivot shaft forward and backward into an inclined state for adjusting the angle (as shown in FIG. 6). An operation table 139 is disposed on the top face of the operation block 138. The other side of the platform 112 is formed with a window 1121 corresponding to a spraying system 14 which is vertically movable and adjustable in height. The spraying system 14 includes an upper support seat 141 and a lower support seat 142 smaller than the window 1121. Four columns 143 are respectively disposed in four corners between the upper and lower support seats 141, 142. A material-supplying container 144 is disposed on the lower support seat 142. A high-pressure pump 145 is positioned on the upper support seat 141. The high-pressure pump 145 is equipped with a muffler and an air motor and has an intake 1451 and an output port 1452. A pipeline filter is disposed in the high-pressure pump 145 to communicate with the intake 1451 and the output port 1452. The intake 1451 extends into the material-supplying container 144. Two posts 146 are arranged on the platform 112 corresponding to two rear columns 143. The two columns 143 are equipped with locating slide blocks 147 having through holes 1471. The locating slide blocks 147 are vertically movable along the posts 146 as shown in FIG. 7 so as to adjust the height of the spraying system 14. An infrared high-pressure automatic spraying gun 148 is connected with the output port 1452 of the high-pressure pump 145. A filter is disposed in the barrel 1481 in cooperation with various sizes of high-pressure nozzles 1482. The nozzle 1482 is positioned right above the operation table 139. The first-stage, the second-stage and the third-stage temperature controls 122, 123, 124 are respectively electrically connected to the material-supplying container 144, the high-pressure pump 145 and the high-pressure automatic spraying gun 148 for heating the same to a set temperature. In addition, the high-pressure automatic spraying gun 148 is controlled by a pedal switch 15.

Figure 8:
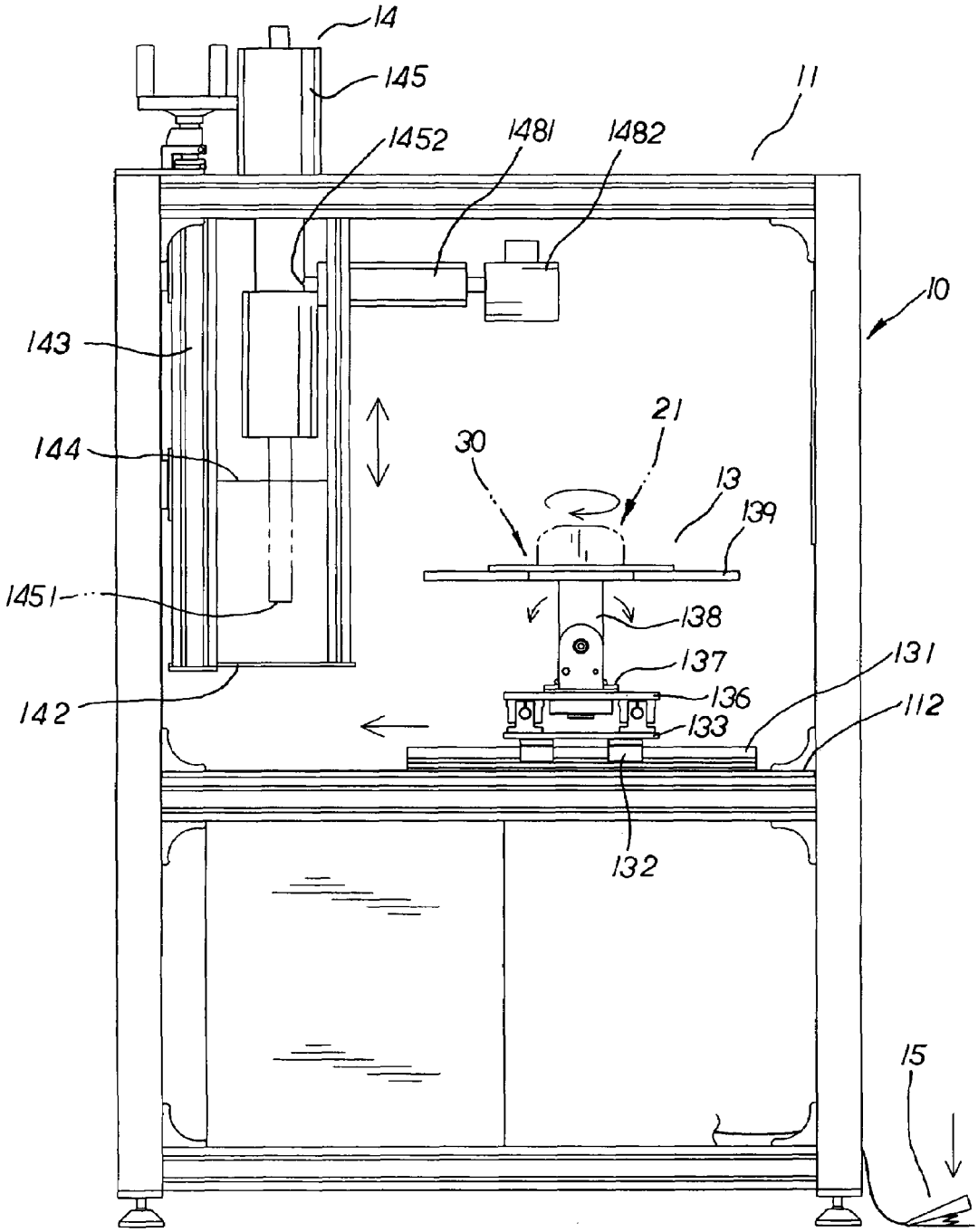
FIG. 8 is a side view of the present invention, showing the operation thereof.
Figure 9:
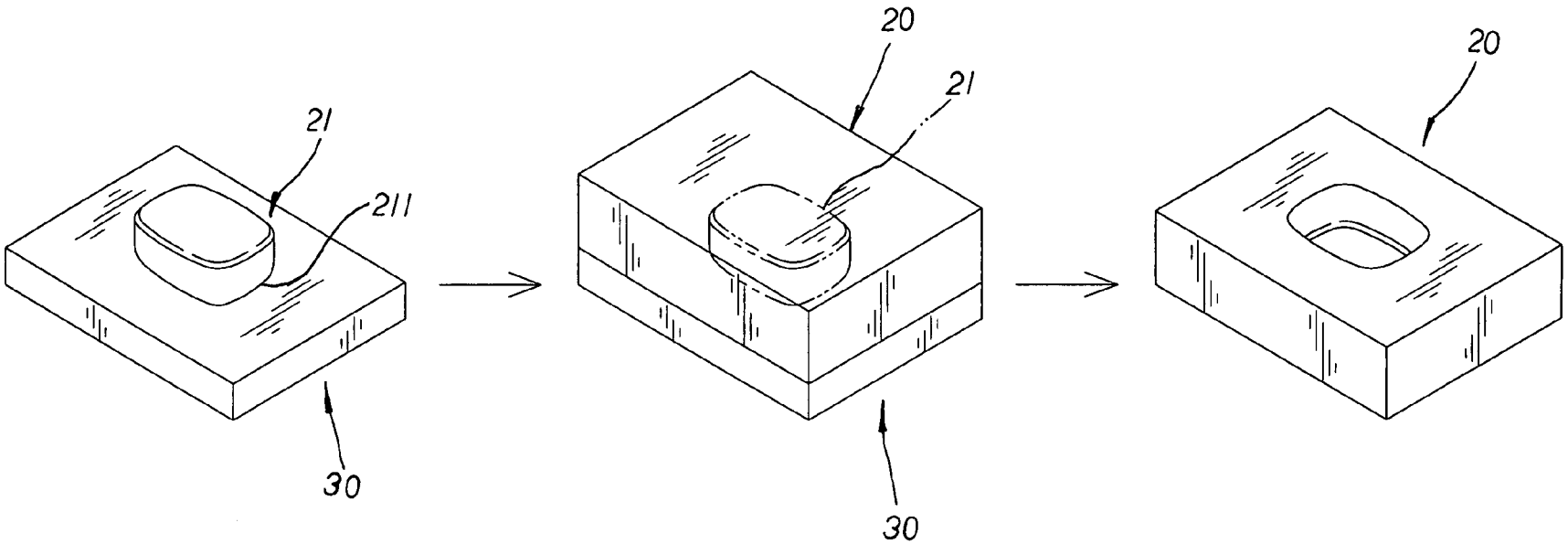
FIG. 9 is a flow chart of the spraying operation of the present invention for forming the low-melting-point metal mold (female mold section)
Figure 10:
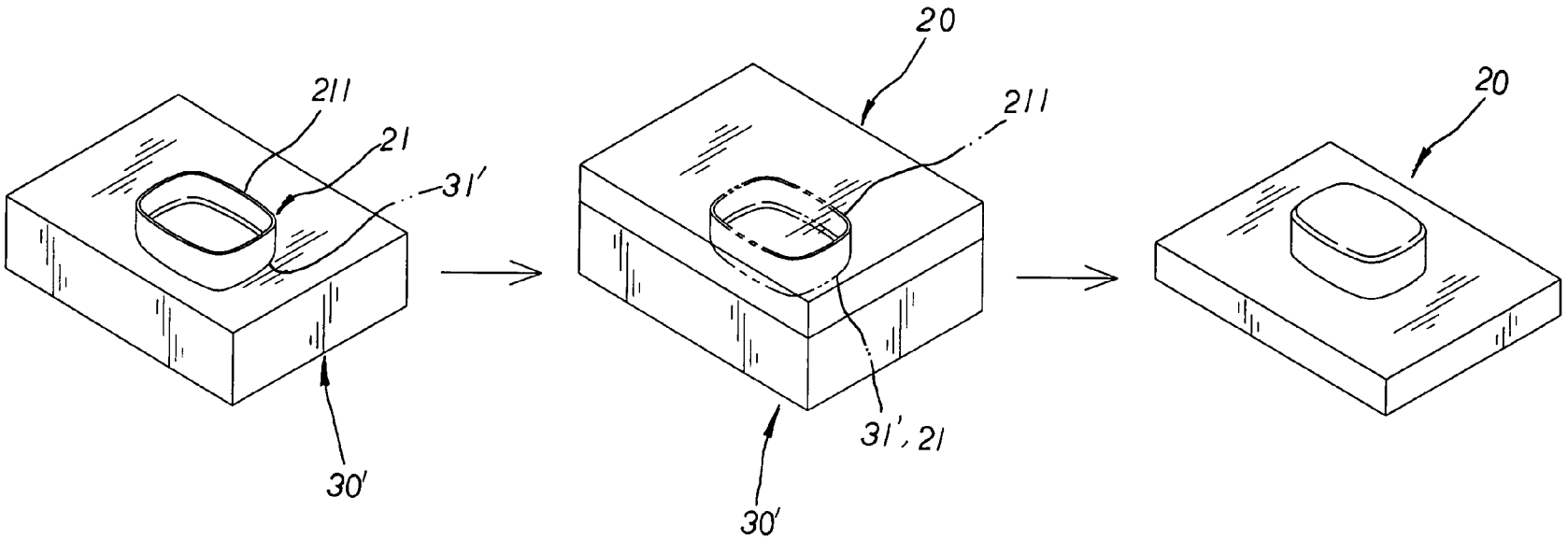
FIG. 10 is a flow chart of the spraying operation of the present invention for forming the low-melting-point metal mold (male mold section).

In operation, the apparatus is first connected to the power supply (monophase 220V) and the air source (over 1 HP, dried and filtered) of the high-pressure pump 145. Then a nozzle 1482 of a desired size is selected and mounted on the high-pressure automatic spraying gun 148. Then the low-melting-point metal is placed in the material-supplying container 144. Then the first-stage temperature control 122 is set about 220° C., the second-stage temperature control 123 is set about 200° C. and the third-stage temperature control 124 is set about 250° C. Then the power switch 121 is switched on, whereby the material-supplying container 144, the high-pressure pump 145 and the high-pressure automatic spraying gun 148 are respectively heated by the first-stage, the second-stage and the third-stage temperature controls 122, 123, 124 to the set temperatures. After the low-melting-point metal is heated and molten into liquid metal in the material-supplying container 144, the input air pressure of the high-pressure pump 145 is set according to required pressure. (In the present apparatus, the ratio is 32:1, that is, in the case that an air pressure of 1 $kg/cm^2$ is input, an air pressure of 32 $kg/cm^2$ is output.) The high-pressure pump 145 is turned on. The pressure of the air pressure regulator of the pedal switch 15 is set within 4 $kg/cm^2$~5 $kg/cm^2$. At this time, an operator can stand in front of the transparent board 114 of the spraying apparatus 10. A model 21 is placed on a mold-dividing board 30 with the cavity 211 facing downward. The mold-dividing board 30 with the model 21 is placed from the operation area 116 onto the operation table 139. The surfaces of the mold-dividing board 30 and the model 21 are painted with an isolating coating. Then, according to the position of the infrared ray of the high-pressure automatic spraying gun 148, the operation table 139 is moved to aim the nozzle 1482 at the model 21 and the mold-dividing board 30 (as shown in FIG. 8). Then the pedal switch 15 is pedaled to take the molten metal from the material-supplying container 144 through the intake 1451 of the high-pressure pump 145 to the output port 1452 and the barrel 1481 of the high-pressure spraying gun 148. The molten metal is then sprayed out from the nozzle 1482 onto the surface of the model 21. The molten metal is sprayed onto the surface of the model 21 many times to form a metal coating thereon without contraction. The mold is made by means of many times of spraying operation so that the mold will not deform due to internal stress. After a thickness of molten metal is sprayed on the surfaces of the model 21 and the mold-dividing board 30, the nozzle 1482 stops from spraying molten metal onto the surfaces and the mold-dividing board 30 is removed. The low-melting-point metal mold 20 is then turned over to form a female mold section as shown in FIG. 9. In the case that the model 21 is placed in a recess 31' of a mold-dividing board 30' with the cavity 211 facing upward, the low-melting-point metal mold 20' achieved by the spraying operation forms a male mold section as shown in FIG. 10. The low-melting-point. metal molds 20, 20' are free from the problems of contraction and deformation. In addition, the molds can be more quickly made at higher precision. Also, when not used, the low-melting-point metal molds can be recovered and molten into liquid metal for reuse. (The recovery ratio is up to 80~95%.) The low-melting-point metal mold will not lead to any environmental problem. By means of the back and forth movable first substrate board 133, the left and right movable second substrate board 136, the 360-degree rotatable rotary tray 137 and the pivotable operation block 138, the spraying position can be mobilely multidirectionally adjusted to facilitate the spraying operation. By means of the shielding boards 113 and the transparent board 114 which define a close space 115 above the platform 112, the spraying operation is performed in the close space 115. Therefore, the operator will not contact with the molten metal to ensure safety.

The adjustment seat 13 is controllable by a crank-type operation panel or a press-button-type operation panel to adjust the angle.

The above embodiments are only used to illustrate the present invention, not intended to limit the scope thereof. Many modifications of the above embodiments can be made without departing from the spirit of the present invention.

What is claimed is:

1. A spraying apparatus for forming low-melting-point metal mold, comprising a frame body having a platform, a close space being defined above the platform, an operation area being formed on one side of the frame body to communicate with the close space, an adjustment seat being arranged on one side of the platform corresponding to the operation area, the adjustment seat being multidirectionally displaceable and 360-degree rotatable and adjustable in angle, an operation table being disposed on the adjustment seat, a spraying system being mounted on the other side of the platform, the spraying system being adjustable in height, the spraying system including a material-supplying container, a high-pressure pump and a spraying gun, a temperature-controlling box being disposed on a lower side of the frame body, the temperature-controlling box having a power switch, a first-stage temperature control, a second-stage temperature control and a third-stage temperature control, the first-stage, the second-stage and the third-stage temperature controls being respectively electrically connected to the material-supplying container, the high-pressure pump and the spraying gun for heating the same to a set temperature, the spraying gun being controlled by a pedal switch, various sizes of nozzles being adaptable to the spraying gun for performing spraying operation to form the low-melting-point metal mold.

2. The spraying apparatus for forming low-melting-point metal mold as claimed in claim 1, wherein the frame body is composed of several longitudinal columns and transverse beams connected with each other.

3. The spraying apparatus for forming low-melting-point metal mold as claimed in claim 1, wherein three shielding boards and a narrower transparent board are respectively disposed on four sides of the frame body above the platform to define the close space and the operation area.

4. The spraying apparatus for forming low-melting-point metal mold as claimed in claim 1, wherein the adjustment seat includes a pair of T-shaped guide rails symmetrically fixedly arranged on the platform, a first substrate board having U-shaped first slide blocks being disposed on the guide rails, the first slide blocks being back and forth movable along the guide rails, two guide rods being symmetrically mounted on two sides of the first substrate board, the guide rods being fitted through the through holes of several second slide blocks to connect with a second substrate board, the second slide blocks being left and right movable along the guide rods, a 360-degree rotatable rotary tray being disposed at a center of the second substrate board, the rotary tray being U-shaped and having two support plates, an operation block being pivotally disposed between the support plates via a pivot shaft, the operation block being restricted by the support plates, whereby the operation block can be pivoted about the pivot shaft forward and backward into an inclined state for adjusting the angle, the operation table being disposed on a top face of the operation block.

5. The spraying apparatus for forming low-melting-point metal mold as claimed in claim 4, wherein the guide rods have a circular cross-section, a rectangular cross-section or any otherwise shaped cross-section.

6. The spraying apparatus for forming low-melting-point metal mold as claimed in claim 1, wherein the other side of the platform is formed with a window corresponding to the spraying system.

7. The spraying apparatus for forming low-melting-point metal mold as claimed in claim 1, wherein the spraying system includes an upper support seat and a lower support seat smaller than the window, four columns being respectively disposed in four corners between the upper and lower support seats, two posts being arranged on the platform corresponding to two rear columns, the two rear columns being equipped with locating slide blocks having through holes, whereby the locating slide blocks are vertically movable along the posts so as to adjust the height of the spraying system.

8. The spraying apparatus for forming low-melting-point metal mold as claimed in claim 7, wherein the material-supplying container is disposed on the lower support seat and the high-pressure pump is disposed on the upper support seat.

9. The spraying apparatus for forming low-melting-point metal mold as claimed in claim 1, wherein a pipeline filter is disposed in the high-pressure pump and the spraying gun is equipped with infrared unit for adjusting the spraying position, a filter being disposed in the barrel of the spraying gun.

10. The spraying apparatus for forming low-melting-point metal mold as claimed in claim 1, wherein the adjustment seat is controllable by a crank-type operation panel or a press-button-type operation panel to adjust the angle.

* * * * *